US007107945B2

(12) United States Patent
Fuwa

(10) Patent No.: US 7,107,945 B2
(45) Date of Patent: Sep. 19, 2006

(54) ELECTROMAGNETICALLY DRIVEN VALVE CONTROL SYSTEM AND METHOD

(75) Inventor: Toshio Fuwa, Nissin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/793,813

(22) Filed: Mar. 8, 2004

(65) Prior Publication Data

US 2004/0187814 A1 Sep. 30, 2004

(30) Foreign Application Priority Data

Mar. 25, 2003 (JP) ..... 2003-081661

(51) Int. Cl.
*F01L 9/04* (2006.01)

(52) U.S. Cl. ..... 123/90.11; 251/129.01; 251/129.16

(58) Field of Classification Search ..... 123/90.11; 251/129.01, 129.02, 129.15, 129.16, 129.18, 251/129.19
See application file for complete search history.

(56) References Cited

U.S. PATENT DOCUMENTS 6,269,784 B1 * 8/2001 Newton ..... 123/90.11
6,321,700 B1 * 11/2001 Hein et al. ..... 123/90.11

FOREIGN PATENT DOCUMENTS

| | | |
|---|---|---|
| DE | 33 07 683 C1 | 7/1984 |
| DE | 199 54 416 A1 | 11/1999 |
| JP | A 11-62529 | 3/1999 |

* cited by examiner

*Primary Examiner*—Thomas Denion
*Assistant Examiner*—Ching Chang
(74) *Attorney, Agent, or Firm*—Kenyon & Kenyon LLP

(57) ABSTRACT

In an electromagnetically driven valve control system, it is determined whether an electromagnetically driven valve is in an attraction period at which a valve body is displaced. When it is determined that the electromagnetically driven valve is in the attraction period, it is further determined whether the period is in a first attraction period at which the valve body is close to a neutral position. When it is determined that the valve body is in the first attraction period, the upper control frequency or the lower control frequency is set to the value indicating the low frequency. When it is determined that the valve body is in the second attraction period at which the valve body is close to either the full-open position or the full-close position, the upper control frequency or the lower control frequency is set to the value indicating the high frequency.

6 Claims, 6 Drawing Sheets

(T4)
(T5)
(T6)
T1
T2
T3
T4
T5
T6
T7
T8
T9
T10
T11
DISPLACEMENT
FULL CLOSE
P1
NEUTRAL
P2
FULL OPEN
IC42
IH
IE
Ia
0
IC46
f42
F0
FH
FL
f46

ELECTROMAGNETICALLY DRIVEN VALVE CONTROL SYSTEM AND METHOD

INCORPORATION BY REFERENCE

The disclosure of Japanese Patent Application No. 2003-81661 filed on Mar. 25, 2003, including the specification, drawings and abstract are incorporated herein by reference in its entirety.

BACKGROUND OF THE INVENTION

1. Field of Invention

The invention relates to a control system for an electromagnetically driven valve provided in an internal combustion engine.

2. Description of Related Art

JP-A-11-62529 discloses the technology for adjusting control frequency of a switching element upon control of exciting current supplied to an electromagnetic coil. In the aforementioned publication, the control frequency of the switching element is set to a high frequency upon displacement of a movable member of the electromagnetically driven valve so as to reduce operation noise generated when the movable member reaches one of displacement ends. Meanwhile the control frequency of the switching element is set to a low frequency when the movable member is held in the displacement end so as to suppress an energy consumption and heat generation owing to switching loss as least as possible.

The displacement of the movable member does not always require setting of the control frequency of the switching element to the high value. In the aforementioned publication, however, as the control frequency of the switching element is always set to the high value upon displacement of the movable member, the energy consumption and heat generation owing to switching loss unnecessarily occur.

SUMMARY OF THE INVENTION

An object of the invention is to efficiently suppress energy consumption and heat generation owing to switching loss in the electromagnetically driven valve for an internal combustion engine.

An embodiment of the invention relates to a control system of an electromagnetically driven valve for an internal combustion engine. The control system is provided in the internal combustion engine, and used for the electromagnetically driven valve provided with an electromagnetic coil for generating electromagnetic force and a movable member that is moved by the electromagnetic force. The intensity of current flowing through the electromagnetic coil is controlled by ON/OFF operation of a switching element.

The control system includes a device for changing the control frequency of the switching element based on a predetermined condition during a period where the movable member of the electromagnetically driven valve is attracted to one of displacement ends (simply referred to as "attraction period"). The predetermined condition is evaluated to determine the degree of accuracy required in controlling current supplied to the electromagnetic coil. The control frequency can be changed based on the predetermined condition even during the attraction period of the movable member. This enables preferred control of energy consumption and heat generation due to switching loss which also maintains sufficient accuracy in the current control.

The control frequency of the switching element may be changed during the attraction period in accordance with a position of the movable member. Typically, relatively high accuracy is required in the current control when the movable member is close to one of the displacement ends so as to reduce operation noise in the electromagnetically driven valve or to stabilize the valve operation. For example, it is determined whether the position of the movable member is close to one of the displacement ends. Then the control frequency of the switching element is changed in accordance with the position of the movable member such that energy consumption and heat generation due to switching loss can be appropriately controlled.

The control frequency of the switching element may be changed during the attraction period in accordance with a load state of the internal combustion engine. The load state of the internal combustion engine, for example, corresponds to an opening degree of an accelerator pedal, intake air quantity and the like. Since the level of the noise generated during the high load engine operation is substantially high, reduction in the operation noise of the electromagnetically driven valve is not so important. For example, the determination as to the accuracy in the current control ma be made by determining whether the engine load is in a low area. If the control frequency of the switching element is changed based on both the position of the movable member and the load of the engine operation, energy consumption and heat generation owing to switching loss can controlled more appropriately.

DETAILED DESCRIPTION OF THE INVENTION

Figure 1:
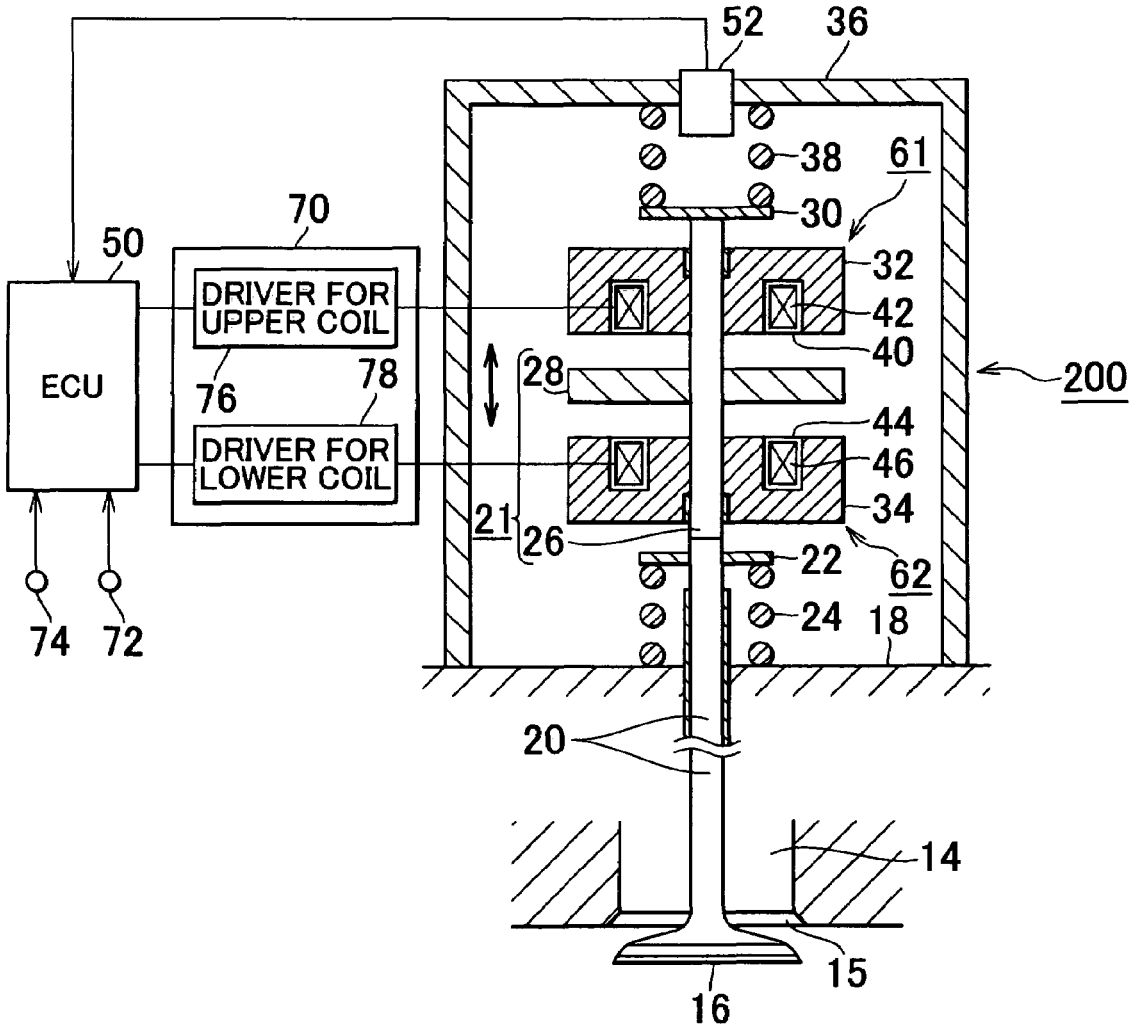
FIG. 1 is a view of a structure representing an electromagnetically driven valve, and an ECU and a valve driver which constitute an electromagnetically driven valve control system according to an embodiment of the invention.

FIG. 1 shows a structure of one of electromagnetically driven valves 200, and an ECU 50 and a valve driver 70 which constitute a control unit of the electromagnetically driven valve 200. Both intake and exhaust valves are formed to be electromagnetically driven as shown in FIG. 1 so as to be operated with electromagnetic force of an electromagnet. As the intake valve is controlled in the same manner as the exhaust valve, the explanation about the valve control operation will be described with respect only to the exhaust valve hereinafter.

The electromagnetically driven valve 200 is provided with a valve shaft 20 that is supported reciprocably within a cylinder head 18, a valve body 16 formed in an upper end portion of the valve shaft 20 as shown in FIG. 1, and an electromagnetic drive portion 21 operated in conjunction with the valve shaft 20. An exhaust port 14 communicated with a combustion chamber is formed in the cylinder head 18. A valve seat 15 is formed around an opening of the exhaust port 14. As the valve shaft 20 reciprocates, the valve body 16 moves toward or away from the valve seat 15 such that the exhaust port 14 is opened or closed.

The valve shaft 20 is provided with a lower retainer 22 at one end opposite to the other end around the valve body 16. A lower spring 24 is provided under pressure between the lower retainer 22 and the cylinder head 18. The valve body 16 and the valve shaft 20 are urged in a valve closing direction, that is, upward direction as shown in FIG. 1 with elastic force of the lower spring 24.

The electromagnetic drive portion 21 is provided with an armature shaft 26 mounted coaxially with the valve shaft 20 and an armature 28. The armature 28 having a disc-like shape and formed of the material with high permeability is fixed in a substantially center portion of the armature shaft 26. An upper retainer 30 is fixed in one end of the armature shaft 26. The other end of the armature shaft 26 abuts on the end portion of the valve shaft 20 at the side of the lower retainer 22.

An upper core 32 is fixed between the upper retainer 30 and the armature 28 within a casing 36 mounted on the cylinder head 18. A lower core 34 is also fixed between the armature 28 and the lower retainer 22 within the casing 36. Each of the upper core 32 and the lower core 34 is formed into an annular shape and of a material with high permeability. The armature shaft 26 is reciprocably provided through the center portion of the upper core 32 and the lower core 34.

An upper spring 38 is provided under pressure between an inner upper surface of the casing 36 and the upper retainer 30. The armature shaft 26 is urged in the downward direction as shown in FIG. 1 at the side of the valve shaft 20 with the elastic force of the upper spring 38. The valve shaft 20 and the valve body 16 are urged in the valve opening direction, that is, downward direction as shown in FIG. 1 by the armature shaft 26. The armature 28, the armature shaft 26, the valve shaft 20, and the valve body 16 constitute a movable member.

A displacement sensor 52 is attached on a top portion of the casing 36. The displacement sensor 52 outputs a voltage signal that changes in accordance with the distance with respect to the upper retainer 30.

A first channel 40 with an annular shape is formed in the upper core 32 on the surface that faces the armature 28, which is centered at the core of the armature shaft 26. The upper coil 42 is provided within the first channel 40. An upper electromagnet 61 is defined by the upper coil 42 and the upper core 32 for driving the valve body 16 to the valve closing direction, that is, upward direction as shown in FIG. 1.

A second channel 44 with an annular shape is formed in the lower core 34 on the surface that faces the armature 28, which is centered at the core of the armature shaft 26. A lower coil 46 is provided within the second channel 44. A lower electromagnet 62 is defined by the lower coil 46 and the lower core 34 for driving the intake valve in the valve opening direction, that is, downward direction as shown in FIG. 1. The upper coil 42 of the upper electromagnet 61 and the lower coil 46 of the lower electromagnet 62 are applied with electric current so as to be controlled by the ECU 50 that executes various control operations of the internal combustion engine.

The ECU 50 includes CPU and memory (not shown), and receives detection signals of various sensors, for example, the displacement sensor 52, a crank angle sensor 72, an accelerator position sensor 74 and the like. The valve driver 70 is provided with a driver 76 for upper coil which controls exciting current flowing through the upper coil 42 in response to the command of the ECU 50, and a driver 78 for lower coil which controls exciting current flowing through the lower coil 46 in response to the command of the ECU 50.

Figure 2:
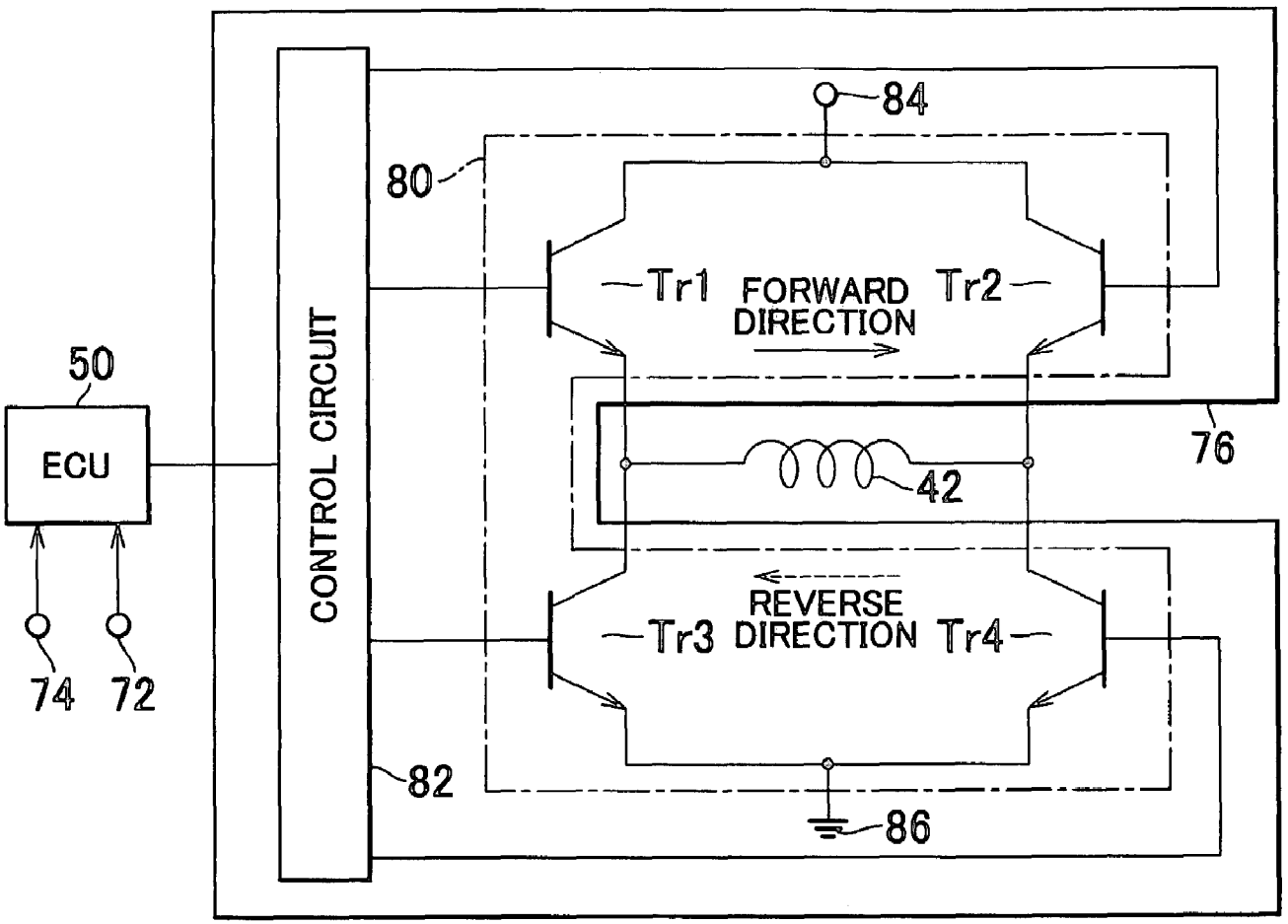
FIG. 2 is a view representing a driver for an upper coil according to the embodiment of the invention.

FIG. 2 shows the structure of the driver 76 for upper coil. The structure and operation of the driver 78 for lower coil are the same as those of the driver 76 for upper coil. Accordingly, the structure and the operation of the driver 76 for upper coil will only be described hereinafter.

The driver 76 for upper coil is provided with a drive circuit 80 of a known H-bridge type including first to fourth transistors Tr1 to Tr4 each functioning as a switching element, a control circuit 82 that supplies control signals for driving those transistors, a power supply terminal 84 that supplies power to the drive circuit 80, and a ground terminal 86.

In the drive circuit 80, each collector terminal of the first transistor Tr1 and the second transistor Tr2 is connected to the power supply terminal 84. An emitter terminal of the first transistor Tr1 and a collector terminal of the third transistor Tr3 are connected to a left terminal of the upper coil 42 as shown in FIG. 2. Likewise an emitter terminal of the second transistor Tr2 and a collector terminal of the fourth transistor Tr4 are connected to a right terminal of the upper coil 42 as shown in FIG. 2. Each emitter terminal of the third and the fourth transistors Tr3 and Tr4 is connected to the ground terminal 86. Each base terminal of the first to the fourth transistors Tr1 to Tr4 is connected to the control circuit 82. In response to the command from the ECU 50, the control circuit 82 applies the desired voltage to the respective base terminals so as to drive the first to the fourth transistors Tr1 to Tr4 for ON/OFF control.

When exciting current is applied to the upper coil 42 in the forward direction, that is, to the right as shown in FIG. 2, the control circuit 82 applies the voltage at a predetermined level to the base terminal of the fourth transistor Tr4 so as to be turned ON. The control circuit 82 applies the voltage to the base terminal of the first transistor Tr1 at a predetermined level at a duty ratio corresponding to the required exciting current so as to turn the first transistor Tr1 ON. At this time, the control circuit 82 applies no voltage to the second and the third transistors Tr2 and Tr3 so as to be kept in OFF state. Therefore, upon turning ON of the first and the fourth transistors Tr1 and Tr4 by the control circuit 82, the exciting current flows through the path that is formed in series in the order of the power supply terminal 84, the first transistor Tr1, the upper coil 42, the fourth transistor Tr4, and the ground terminal 86.

When exciting current is applied to the upper coil 42 in the reverse direction, that is, to the left as shown in FIG. 2, the control circuit 82 applies the voltage at a predetermined level to the base terminal of the third transistor Tr3 so as to be turned ON. The control circuit 82 applies the voltage to the base terminal of the second transistor Tr2 at a predetermined level at a duty ratio corresponding to the required exciting current so as to turn the second transistor Tr2 ON. At this time, the control circuit 82 applies no voltage to the first and the fourth transistors Tr1 and Tr4 so as to be kept in OFF state. Therefore, upon turning ON of the second and the third transistors Tr2 and Tr3 by the control circuit 82, the exciting current flows through the path that is formed in series in the order of the power supply terminal 84, the second transistor Tr2, the upper coil 42, the third transistor Tr3, and the ground terminal 86.

The ON/OFF control operation of the first and the second transistors Tr1 and Tr2 is executed at a predetermined control frequency. Therefore, the control frequency of the exciting current flowing through the upper coil 42 and the lower coil 46 becomes the same as the control frequency for driving the first and the second transistors Tr1 and Tr2. The duty ratio of the signal for driving the first and the second transistors Tr1 and Tr2 is set by the ECU 50 based on the reference signal at frequency that is different from the control frequency, specifically, higher than the control frequency. Functions of the control circuit 82 may be included in the ECU 50.

The operation of the electromagnetically driven valve 200 will be described referring to FIG. 1. Upon application of exciting current to the upper coil 42, magnetic flux that refluxes the path including the upper core 32 and the armature 28 is generated. The electromagnetic force is generated between the upper core 32 and the armature 28, each of which is attracted with each another.

The electromagnetic force generated between the upper core 32 and the armature 28 serves to move the movable member toward the upper core 32, that is, upward direction as shown in FIG. 1. The armature shaft 26 is structured to be movable until the armature 28 abuts on the upper core 32. At a timing substantially the same as that for the abutment of the armature 28 on the upper core 32, the valve body 16 is seated on the valve seat 15 such that the exhaust port 14 is fully closed. As the valve body 16 is seated on the valve seat 15, and the armature 28 abuts on the upper core 32, the operation noise may occur.

When the valve body 16 is held in the full-close position, the upper spring 38 serves to urge the armature shaft 26 toward the neutral position, that is, in the direction where the intake port 14 is opened. In the aforementioned state, upon stop of application of electric current to the upper coil 42, the armature shaft 26 starts moving toward the full-open position with the elastic force of the upper spring 38 and the lower spring 24.

Upon application of exciting current to the lower coil 42, magnetic flux that refluxes the path including the lower core 34 and the armature 28 is generated. The electromagnetic force is generated between the lower core 34 and the armature 28, each of which is attracted with each other. The electromagnetic force generated between the lower core 34 and the armature 28 moves the movable member toward the lower core 34, that is, in the downward direction as shown in FIG. 1. The armature shaft 26 is structured to be movable until the armature 28 abuts on the lower core 34. When the armature 28 abuts on the lower core 34, the valve body 16 causes the exhaust port 14 to be in the full-open state. At a predetermined timing after stop of application of electric current to the upper coil 42, application of the electric current is started to smoothly move the valve body 16 from the full-close position to the full-open position. As the armature 28 abuts on the lower core 34, operation noise may occur.

When application of electric current to the lower coil 46 is stopped after holding the valve body 16 in the full-open position, the valve body 16 then starts moving to the full-close position. Thereafter electric current is applied to the upper coil 42 and the lower coil 46 repeatedly at an appropriate time interval such that the valve body 16 can be smoothly operated.

The exciting current applied to the upper coil 42 or the lower coil 46 is controlled to be set as the command current. In the case where the level of the accuracy for controlling the exciting current is low, that is, intensity of the electric current becomes relatively higher at a timing just before the valve body 16 reaches the full-close position or the full-open position, noise generated when the valve body 16 is seated on the valve seat 15 or generated when the armature 28 abuts on the upper core 32 or the lower core 34 may be increased, or bounce may occur. It is, therefore, necessary to control the exciting current with high accuracy so as to reduce the noise generated when the valve body 16 reaches the full-close position or the full-open position, or to stabilize the operation.

The accurate control of the exciting current is required especially at the timing just before the valve body 16 reaches the full-open position or the full-close position in view of reduced noise or stabilized operation. Meanwhile, the accurate control of the electric current is not required at the timing when the valve body 16 is close to the neutral position. Since the engine operation at high engine speed or in high load engine operation is likely to generate noise to a certain degree, the accurate control of the exciting current is not required in the aforementioned condition in view of the reduced noise.

The current control to the upper coil 42 or the lower coil 46 will be described referring to a first embodiment and a second embodiment.

FIRST EMBODIMENT

In a first embodiment, the control frequency for driving the switching element is changed in accordance with a position of a movable member in view of the reduced noise and stabilized operation.

In the explanation hereinafter, the time period taken for applying electric current to the upper coil 42 or the lower coil 46 such that the movable member of the electromagnetically driven valve 200 is attracted toward one of displacement ends will be referred to as an attraction period. The control frequency of the switching element in the driver 76 for upper coil and the driver 78 for lower coil is changed in accordance with the position of the movable member in order to change the control frequency of the electric current for reducing energy consumption and heat generation owing to switching loss as well as the reduced noise and stabilized operation. In this embodiment, the position of the valve body 16 represents the position of the movable member.

Figures 3A, 3B, 3C, 3D, 3E:
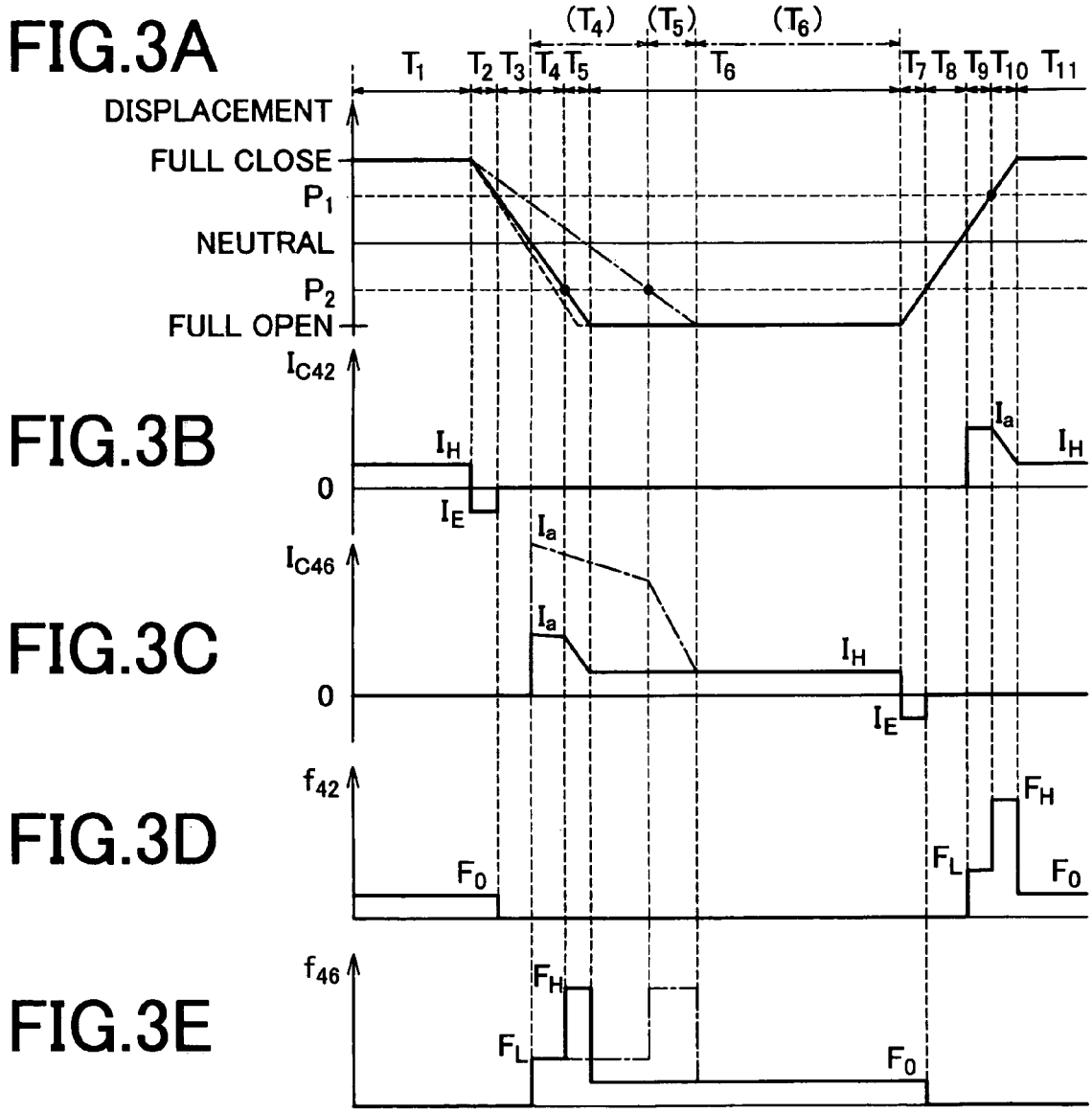
FIG. 3A is a timing chart representing a displacement pattern of a valve body.
FIG. 3B is a timing chart representing change in an upper command current $I_{C42}$ received by a control circuit from the ECU for executing current control of the upper coil.
FIG. 3C is a timing chart representing change in a lower command current $I_{C46}$ received by a control circuit from the ECU for executing current control of the lower coil.
FIG. 3D is a timing chart representing change in a switching element control frequency $f_{42}$ of a driver for the upper coil.
FIG. 3E is a timing chart representing change in a switching element control frequency $f_{46}$ of a driver for the lower coil.

FIG. 3A represents a displacement pattern of the valve body 16. FIG. 3B represents the change in the command current $I_C$ (hereinafter simply referred to as upper command current $I_{C42}$) sent to the control circuit 82 from the ECU 50 so as to realize the current control with respect to the upper coil 42. FIG. 3C represents the change in the command current $I_C$ (hereinafter simply referred to as lower command current $I_{C46}$) sent to the control circuit 82 from the ECU 50 so as to realize the current control with respect to the lower coil 46. FIG. 3D represents the change in the control frequency $f_{42}$ (hereinafter simply referred to as upper control frequency $f_{42}$) of the switching element of the driver 76 for upper coil. FIG. 3E represents the change in the control frequency $f_{46}$ (hereinafter simply referred to as lower control frequency $f_{46}$) of the switching element of the driver 78 for lower coil.

Referring to FIG. 3A, the pattern illustrated by a dashed line shows a target displacement of the valve body 16 during the period taken for the displacement from the full-close position to the full-open position, the pattern illustrated by a solid line shows an actual displacement in the low load engine operation, and the pattern illustrated by a chain line shows an actual displacement in the high load engine operation. Referring to FIG. 3C, the pattern illustrated by a solid line shows the lower command current $I_{C46}$ in the low load engine operation, the pattern illustrated by a chain line shows the lower command current $I_{C46}$ in the high load engine operation. Referring to FIG. 3E, the pattern illustrated by a solid line shows the lower control frequency $f_{46}$ in the low load engine operation, and the pattern illustrated by a chain line shows the lower control frequency $f_{46}$ in the high load engine operation.

Each of the upper command current $I_{C42}$ and the lower command current $I_{C46}$ during the attraction period is set such that the displacement pattern of the movable member becomes a target pattern under feedback control executed by the ECU 50 in accordance with a difference between a predetermined target state value, for example, the position of the movable member, displacement speed, external force exerted to the movable member, and an actual or estimated state value. Referring to FIG. 3A, the displacement pattern in the engine operation with no load may be set as the target displacement pattern. If the external force can be actually measured or estimated, the target state value may be set in accordance with such external force. In the case where the engine is operated in the high load state, combustion may increase the in-cylinder pressure. As a result, the external force exerted to the valve body 16 is increased upon displacement of the valve body 16 from the full-close position to the full-open position. This may cause the actual displacement to deviate from the target displacement as shown in FIG. 3A, and the lower command current $I_{C46}$ is set to the value that is relatively higher than that in the low load engine operation as shown in FIG. 3C. In this embodiment, the time for current control in a single cycle for operating the valve body 16 is divided into 10 time sections, that is, the first time section T1 to the tenth time section T10. Each of the divided time section of the current control will be described hereinafter. The fourth to sixth time sections $T_4$, $T_5$, and $T_6$ in the high load engine operation will be referred to as $T_4$, $T_5$, and $T_6$, respectively in the drawing.

In the first time section T1 at which the valve body 16 is held in the full-close state, the upper command current $I_{C42}$ is controlled to a predetermined holding current $I_H$ (>0). The holding current $I_H$ may take a constant value or may be set to the value by adding a feedback current value to the constant value. In this time section, the lower command current $I_{C46}$ zero. In the first time section $T_1$, the upper control frequency $f_{42}$ is set to the frequency $F_0$ that is lower than the frequency in the fourth time section $T_4$ or in the ninth time section $T_9$. The first time section $T_1$ is equivalent to the eleventh time section T11 in the single operation cycle of the valve body 16. The time sections from $T_1$ to $T_{10}$, therefore, constitute the single operation cycle of the valve body 16.

When the first time section $T_1$ at which the valve body 16 is in the full-close state expires, the valve body 16 is required to be brought into the full-open state from the full-close state. Then in the second time section $T_2$, the residual magnetism in the upper core 32 is immediately demagnetized, and the upper command current $I_{C42}$ is controlled to a predetermined demagnetizing current $I_E$ (<0) in the direction opposite to the holding current $I_H$ so as to smoothly start displacing the valve body 16.

When the second time section $T_2$ at which the upper command current $I_{C42}$ is controlled to be set at the demagnetizing current $I_E$, the upper command current $I_{C42}$ and the lower command current $I_{C46}$ are both set to zero in the third time section $T_3$. The valve body 16 is moved toward the full-open position under the elastic force of the upper spring 38.

The fourth time section $T_4$ starts on the way of the displacement of the valve body 16 from the full-close position to the full-open position. The difference between the predetermined target value and the actual or estimated state value is obtained under the feedback control executed by the ECU 50. The lower command current $I_{C46}$ is controlled to be set at a desired current Ia in accordance with the obtained difference. At this time, the accurate control for the exciting current is not required. Therefore, the lower control frequency $f_{46}$ is set to a low frequency $F_L$. The start of the fourth time section $T_4$ may be determined in accordance with the position of the valve body 16, the displacement speed, engine load and the like.

The fifth time section $T_5$ starts when the valve body 16 reaches a frequency switching point $P_2$ on the way of the displacement from the full-close position to the full-open position. In the fifth time section $T_5$, the valve body 16 is approaching the full-open position. Therefore, the lower control frequency $f_{46}$ is set at a high frequency $F_H$ for reducing the operation noise and stabilizing the operation.

The fifth time section $T_5$ expires when it is confirmed that the armature 28 abuts on the lower core 34 to allow the valve body 16 to be in the full-open state. The feedback control is then stopped, and the lower command current $I_{C46}$ is controlled to be set at a predetermined holding current $I_H$. The fifth time section $T_5$ may be continued for a certain period after the armature 28 abuts on the lower core 34 to allow the valve body 16 to be in the full-open state until stabilization of the operation of the valve body 16. In the continued fifth time section $T_5$, the feedback control may be continued and the lower control frequency $f_{46}$ may be set at the high frequency $F_H$. The time section for which the lower command current $I_{C46}$ is controlled to be set at the holding current $I_H$ is referred to as the sixth time section $T_6$.

In the sixth time section $T_6$, the lower command current $I_{C46}$ is controlled to be set at the holding current $I_H$. The lower control frequency $f_{46}$ is set at the frequency $F_0$ that is equivalent to the upper control frequency $f_{42}$ in the first time section $T_1$.

Each of the command current and the control frequency to be set in the time sections from $T_7$ to $T_{11}$ takes the pattern that is the same as the one for the command current and the control frequency in the time sections from $T_2$ to $T_6$. In the time sections from $T_7$ to $T_{10}$, the valve body 16 displaces toward the full-close position. The displacement direction in the aforementioned time sections is opposite to that in the time sections from $T_2$ to $T_5$. Likewise in the sixth time section $T_6$, the valve body 16 is held in the full-open state, and in the eleventh time section T11, the valve body 16 is held in the full-close state. As the position of the upper coil 42 is opposite to that of the lower coil 46, each change in the upper command current $I_{C42}$ and the lower command current $I_{C46}$, and in the upper control frequency $f_{42}$ and the lower control frequency $f_{46}$ is reversed. A frequency switching point $P_1$ serves as a boundary between the ninth time section $T_9$ and the tenth time section $T_{10}$ on the way of the displacement of the valve body 16 from the neutral position to the full-close position.

Figure 4:
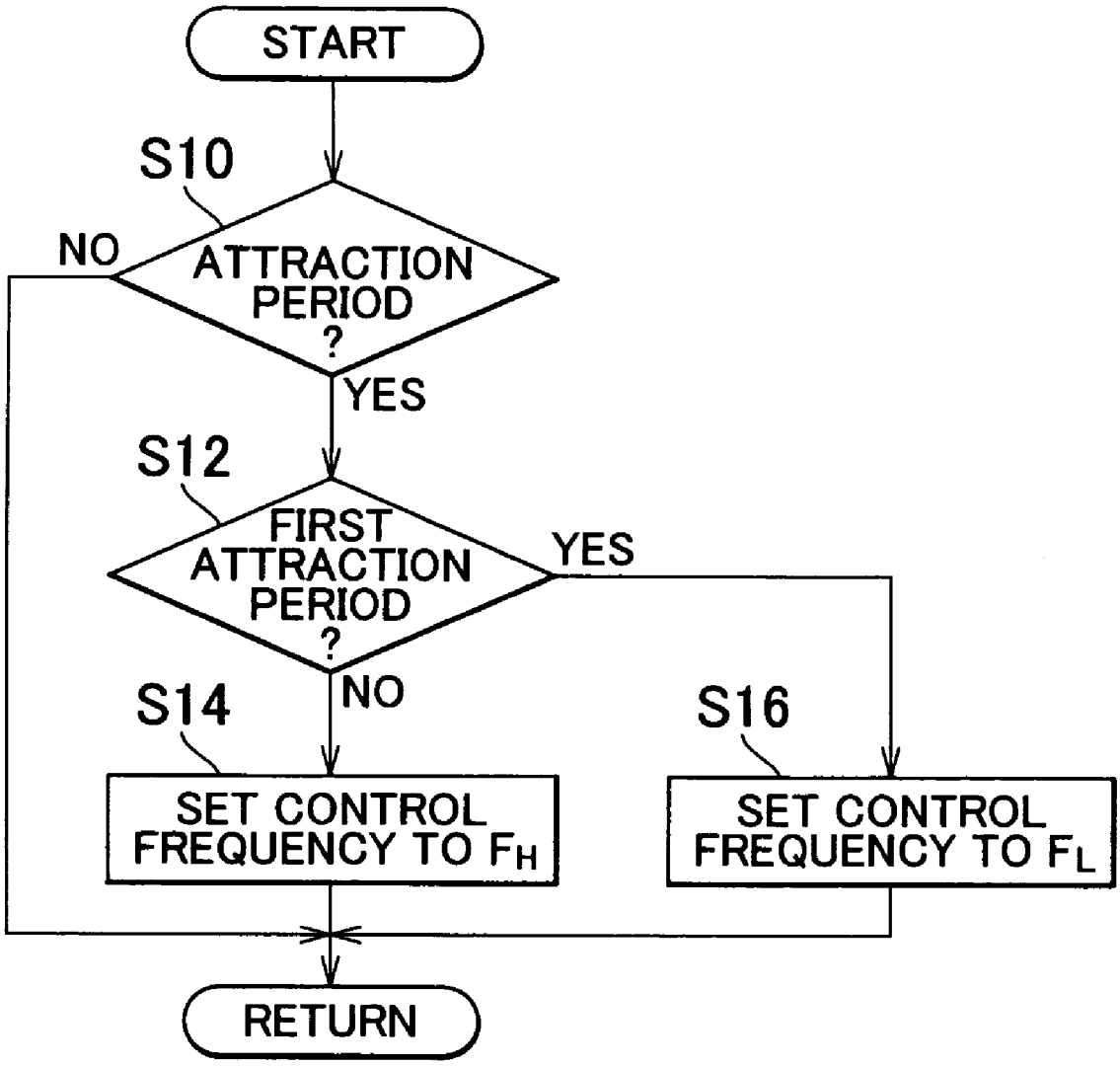
FIG. 4 is a flowchart of a control routine for changing control frequency in accordance with a position of the valve body during displacement of the valve body.

FIG. 4 is a flowchart representing a control routine for changing the control frequency in the attraction period in accordance with the position of the valve body 16. In this control routine, as has been described in FIG. 3, the control frequency for driving the switching element is changed in a first attraction period including the fourth time section $T_4$ in which the lower control frequency $f_{46}$ is set at the low frequency $F_L$ and the ninth time section $T_9$ in which the upper control frequency $f_{42}$ is set at the low frequency $F_L$, and in a second attraction period including the fifth time section $T_5$ in which the lower control frequency $f_{46}$ is set at the high frequency $F_H$ and the tenth time section in which the upper control frequency $f_{42}$ is set at the high frequency $F_H$.

Referring to the flowchart of FIG. 4, the control routine starts every time when the crank angle of the internal combustion engine changes by a predetermined angle based on an output value of the crank angle sensor 72. Upon start of the control routine, the ECU 50 determines whether an electromagnetically driven valve 200 is in the attraction period based on the position of the valve body 16 obtained from the output of a displacement sensor 52, a displacement speed, a load of the engine and the like in step S10.

When YES is obtained in step S10, that is, it is determined that the electromagnetically driven valve 200 is in the attraction period, the ECU 50 determines whether the valve 200 is in the first attraction period (fourth time section $T_4$ or ninth time section $T_9$) or in the second attraction period (fifth time section $T_5$ or tenth time section $T_{10}$) based on the obtained position of the valve body 16 in step S12. When YES is obtained in step S12, that is, the valve 200 is in the first attraction period, the ECU 50 sets the control frequency at the low frequency $F_L$ in step S16. When NO is obtained in step S12, that is, the valve 200 is in the second attraction period, the ECU 50 sets the control frequency at the high frequency $F_H$ in step S14. When it is determined that setting of the control frequency is terminated in step S14 or in step S16, or it is determined that the electromagnetically driven valve 200 is not in the attraction period (NO is obtained in step S10), the control routine ends.

Upon termination of the control routine, the ECU 50 determines the duty ratio corresponding to the required exciting current, and duty drives the first transistor Tr1 or the second transistor Tr2 at the duty ratio in accordance with the direction of the exciting current at a control frequency determined in the control routine. The fourth transistor Tr4 or the third transistor Tr3 is also turned ON correspondingly.

It may be in the case where the valve body 16 may be moved away from the displacement end that is supposed to be held, specifically, step-out occurs while the valve body 16 is held in the full-close state or the full-open state. The valve body 16 in the aforementioned case has to assume its position to the displacement end as soon as possible. When the valve body 16 assumes its position to the displacement end again, the control frequency of the switching element may be changed in accordance with the position of the valve body 16 in the manner as aforementioned. When the step-out occurs, the valve body 16 is likely to be in the position close to the displacement end. In this case, the control frequency of the switching element, that is, the control frequency of the command current is then set at the high frequency $F_H$.

SECOND EMBODIMENT

Figure 5:
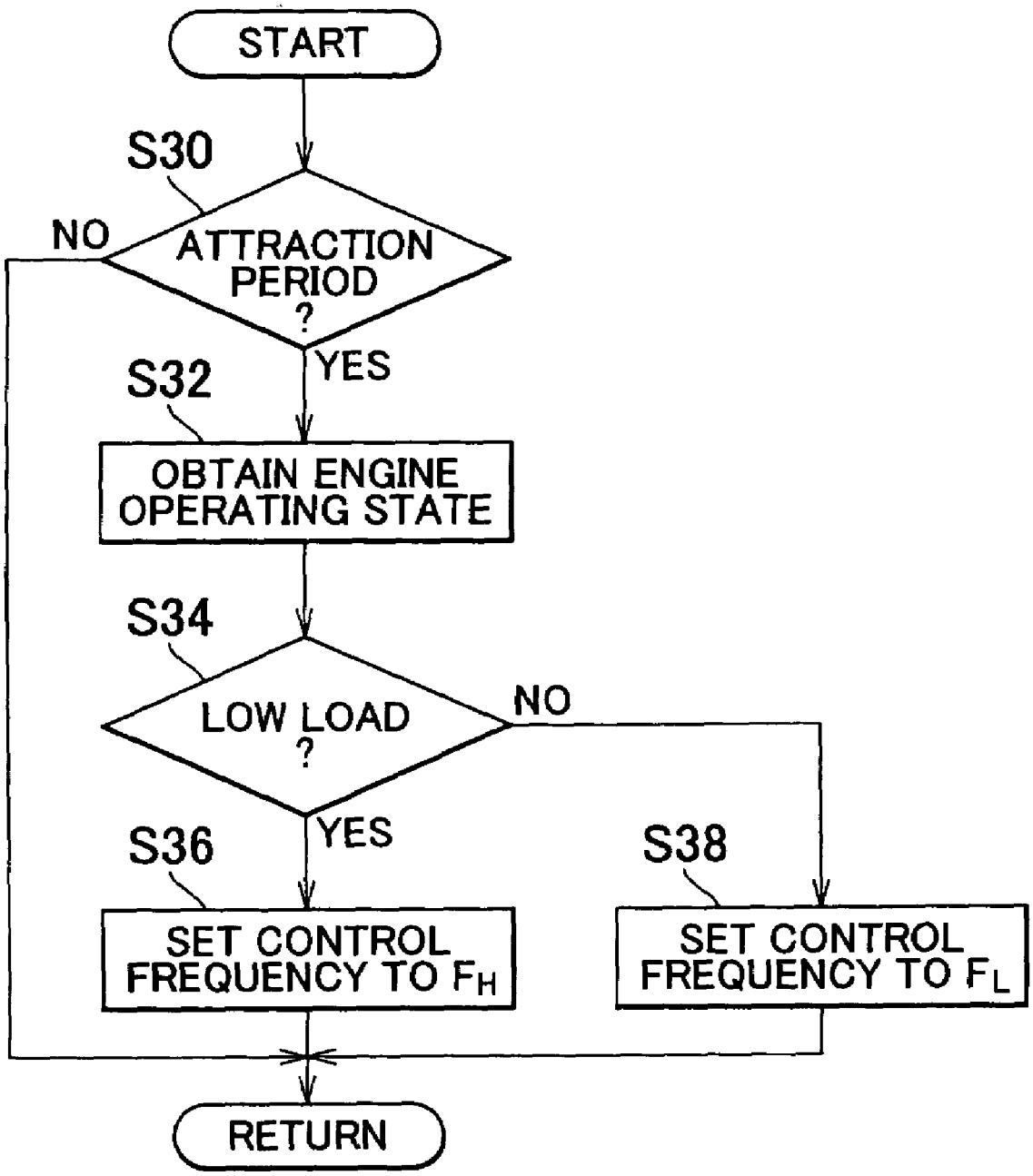
FIG. 5 is a flowchart of a control routine for changing the control frequency in accordance with an operation state of an internal combustion engine during the displacement of the valve body.

In a second embodiment, the control frequency for driving the switching element is changed in accordance with a load of the internal combustion engine in view of the reduced operation noise. The current control in this embodiment is substantially the same as that in the first embodiment except setting of the upper control frequency $f_{42}$ and the lower control frequency $f_{46}$. FIG. 5 is a flowchart representing a control routine for changing the control frequency in the attraction period in accordance with the operation state of the internal combustion engine, which can be replaced with the flowchart of the control routine shown in FIG. 4. The control routine shown in the flowchart of FIG. 5 starts every time when the crank angle in the internal combustion engine changes by a predetermined angle based on the output value of the crank angle sensor 72. Upon start of the control routine, the ECU 50 determines whether the electromagnetically driven valve 200 is in the attraction period based on the position of the valve body 16 obtained from the output of the displacement sensor 52, the displacement speed, the engine load and the like in step S30.

When it is determined that the electromagnetically driven valve 200 is in the attraction period, that is, YES is obtained in step S30, the process proceeds to step S32 where the ECU 50 obtains an engine speed and a load ratio which have been calculated in another routine (not shown) as values indicating the engine operation state. Then in step S34, it is determined whether the engine operation state corresponds to the low load operation state where reduction in the operation noise is required. The ECU 50 stores a predetermined control map (not shown) for making the aforementioned determination. The control map may describe, for example, to set the control frequency at the high frequency $F_H$ if the engine speed is equal to or lower than 1500 rpm, and the load ratio is equal to or lower than 40%, for example. If the engine operation state deviates from the aforementioned range defined by the engine speed and the load ratio, the control map describes to set the control frequency at the low frequency $F_L$.

When it is determined that the engine operation state is in the high load state where the control frequency is not required to be set at the high frequency $F_H$, that is, NO is obtained in step S34, the process proceeds to step S38 where the ECU 50 sets the control frequency at the low frequency $F_L$. When it is determined that the engine operation state is in the low load state where the control frequency is required to be set at the high frequency $F_H$, that is, YES is obtained in step S34, the process proceeds to step 36 where the ECU 50 sets the control frequency at the high Frequency $F_H$. When setting of the control frequency is terminated in step S36 or in step S38, or it is determined that the electromagnetically driven valve 200 is not in the attraction period, that is, NO is obtained in step S30, the control routine ends.

Figure 6:
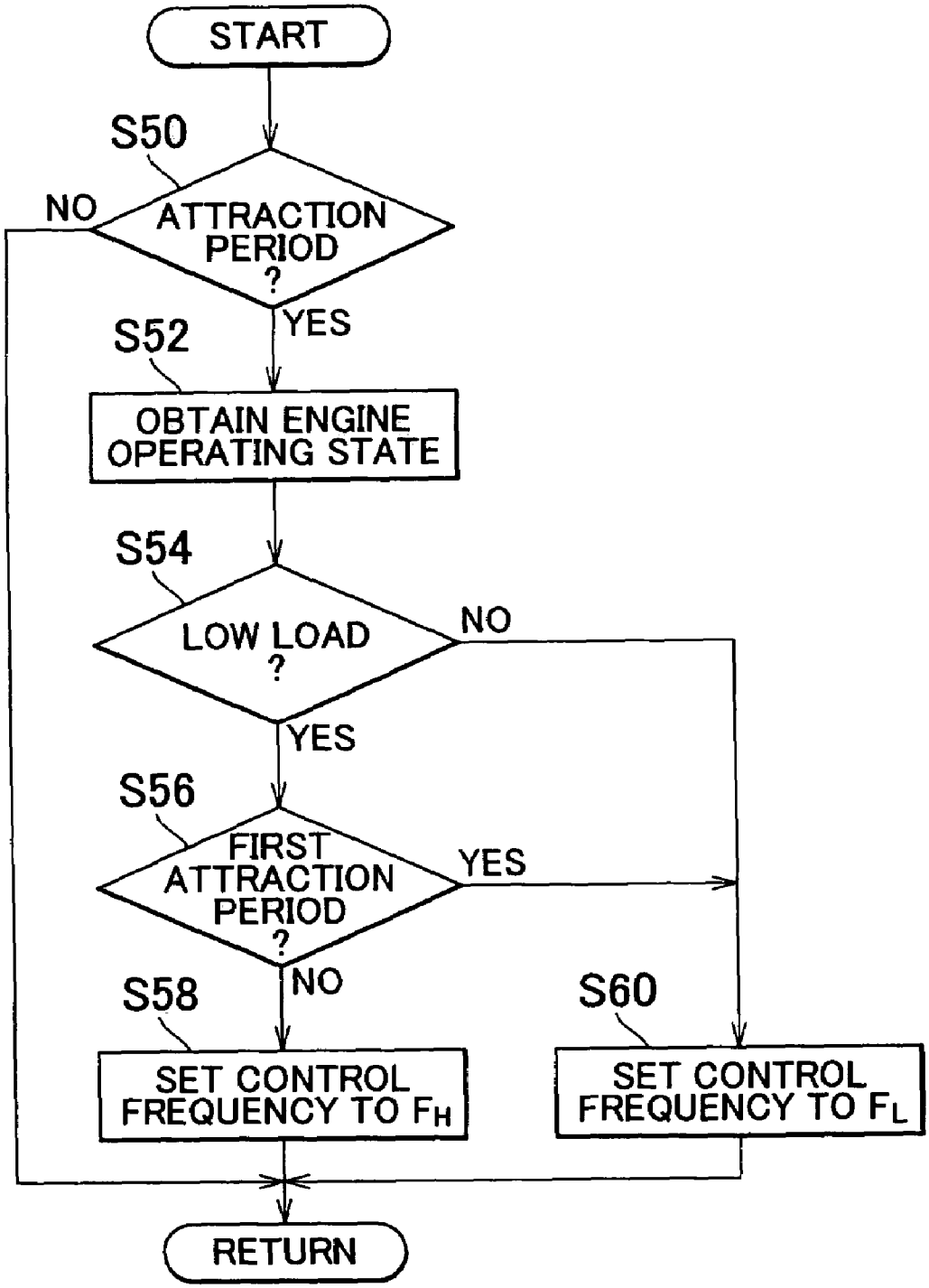
FIG. 6 is a flowchart of a control routine for changing the control frequency in accordance with the operation state of the internal combustion engine and the position of the valve body during the displacement of the valve body.

The aforementioned control routine may be modified in view of the reduced operation noise. FIG. 6 is a flowchart of a control routine for changing the control frequency in the attraction period in accordance with the engine operation state and the position of the valve body 16 to be executed in place of the control routine as shown in the flowchart of FIG. 5. Upon start of the control routine shown in FIG. 6, the ECU 50 determines whether the electromagnetically valve 200 is in the attraction period based on the position of the valve body 16 derived from the output of the displacement sensor 52, the displacement speed, the engine load and the like in step S50. When it is determined that the electromagnetically driven valve 200 is in the attraction period, that is, YES is obtained in step S50, the process proceeds to step S52 where the ECU 50 obtains the engine operation state obtained in another routine (not shown).

Then the ECU 50 determines whether the obtained engine operation state corresponds to the low load state in step S54. When it is determined that the engine operation state corresponds to the low load state, that is, YES is obtained in step S54, the process proceeds to step S56. In step S56, the ECU 50 determines whether the attraction period corresponds to the first attraction period as described in the first embodiment based on the position of the valve body 16 that has been obtained for the determination with respect to the attraction period in step S50. When it is determined that the attraction period does not correspond to the first attraction period, which means that it corresponds to the second attraction period, that is, NO is obtained in step S56, the ECU 50 sets the control frequency at the high frequency $F_H$ in step S58. When it is determined that the engine operation is in the high load state, that is, NO is obtained in step S54, and it is determined in step S56 that the attraction period corresponds to the first attraction period, that is, YES is obtained in step S56, the ECU 50 sets the control frequency at the low frequency $F_L$ in step S60. When setting of the control frequency is terminated in step S58 or in step S60, or the ECU 50 determines that the electromagnetically driven valve 200 is not in the attraction period, that is, NO is obtained in step S50, the control routine ends.

In the aforementioned embodiments, the position of the valve body 16 is considered for determining the need of accuracy for controlling the exciting current supplied to the upper coil 42 or the lower coil 46 by controlling the control frequency for driving the first transistor Tr1 or the second transistor Tr2 as the switching element. This makes it possible to appropriately control energy consumption and heat generation owing to switching loss. The operation state of the engine is considered, in other words, whether or not the engine operation is in the low load area, for determining the need of accuracy for controlling the exciting current supplied to the upper coil 42 or the lower coil 46 by controlling the control frequency for driving the first transistor Tr1 and the second transistor Tr2. This makes it possible to appropriately control energy consumption and heat generation owing to switching loss. If the control frequency for driving the first transistor Tr1 and the second transistor Tr2 is controlled based on both the position of the valve body 16 and the engine operation state, energy consumption and heat generation owing to switching loss may further be appropriately controlled.

In accordance with the invention, energy consumption and heat generation owing to switching loss in the electromagnetically driven valve for the internal combustion engine may be suppressed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. An electromagnetically driven valve control system for an internal combustion engine, comprising:

an electromagnetically driven valve having an electromagnetic coil for generating an electromagnetic force and a movable member that is moved by the electromagnetic force, and a control unit that controls electric current supplied to the electromagnetic coil through a switching element, wherein the control unit is adapted to determine whether the internal combustion engine is running under a low load condition and increase a control frequency of the switching element during application of electric current to the electromagnetic coil to move the movable member towards one of its displacement ends if the internal combustion engine is determined to be running under the low load condition.

2. The electromagnetically driven valve control system according to claim 1, wherein the control unit is further adapted to change the control frequency of the switching element based on a position of the movable member.

3. The electromagnetically driven valve control system according to claim 2, wherein the control unit is further adapted to increase the control frequency of the switching element in response to the movable member reaching a specific position close to the displacement end towards which the movable member is moving.

4. A method of controlling electric current supplied to an electromagnetic coil of an electromagnetically driven valve for an internal combustion engine through a switching element, the method comprising the step of:

determining whether the internal combustion engine is running under a low load condition; and increasing a control frequency of the switching element during application of electric current to the electromagnetic coil to move a movable member of the electromagnetically driven valve towards one of its displacement ends if the internal combustion engine is determined to be running under the low load condition.

5. The method according to claim 4, wherein the control frequency of the switching element is changed based on a position of the movable member.

6. The method according to claim 5, wherein the control frequency of the switching element is increased in response to the movable member reaching a specific position close to the displacement end towards which the movable member is moving.

* * * * *